US009916810B2

(12) United States Patent
Won et al.

(10) Patent No.: US 9,916,810 B2
(45) Date of Patent: Mar. 13, 2018

(54) METHOD OF DRIVING A DISPLAY APPARATUS

(71) Applicant: SAMSUNG DISPLAY CO., LTD., Yongin-Si, Gyeonggi-Do (KR)

(72) Inventors: Byeonghee Won, Hwaseong-si (KR); Jiyoung Moon, Suwon-si (KR); Eun Jin Sung, Yongin-si (KR); Won Sang Park, Yongin-si (KR); Jong-In Baek, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/092,992

(22) Filed: Apr. 7, 2016

(65) Prior Publication Data

US 2017/0098426 A1 Apr. 6, 2017

(30) Foreign Application Priority Data

Oct. 1, 2015 (KR) ..... 10-2015-0138366

(51) Int. Cl.

| | |
|---|---|
| ***G09G 5/02*** | (2006.01) |
| ***G09G 5/10*** | (2006.01) |
| ***G09G 3/34*** | (2006.01) |

(52) U.S. Cl.

CPC ..... *G09G 5/02* (2013.01); *G09G 3/34* (2013.01); *G09G 5/10* (2013.01); *G09G 2360/144* (2013.01)

(58) Field of Classification Search

CPC ..... G09G 5/02; G09G 3/34; G09G 2360/141; G09G 2360/144; G09G 2310/0232

See application file for complete search history.

(56) References Cited

U.S. PATENT DOCUMENTS

| | | | | |
|---|---|---|---|---|
| 6,961,029 | B1 * | 11/2005 | Canova, Jr. ..... | G02F 1/1362 345/55 |
| 2008/0137004 | A1 * | 6/2008 | Iwasaki ..... | G02B 6/0021 349/64 |
| 2014/0159587 | A1 * | 6/2014 | Sezan ..... | G09G 3/3466 315/152 |
| 2015/0009121 | A1 | 1/2015 | Chuang | |

OTHER PUBLICATIONS

"Application Note—Solution of Flickering in TFT" Solomon Systech. Sep. 2008. Accessed online via http://www.solomon-systech.com/files/ck/files/Application%20Notes/TFT%20Flickering%20Application%20Note_1.1.pdf on May 31, 2017.*

* cited by examiner

*Primary Examiner* — Antonio A Caschera

(74) *Attorney, Agent, or Firm* — F. Chau & Associates, LLC

(57) ABSTRACT

In a method of driving a display apparatus, an outside illuminance is sensed by an illuminance sensor. At least one first color subpixel of a plurality of first color subpixels is disabled. Remaining first color subpixels are enabled based on the sensed outside illuminance. The first color subpixels corresponding to a first color are arranged along a first direction and a second direction crossing the first direction. An image is displayed on the remaining enabled first color subpixels.

20 Claims, 15 Drawing Sheets

METHOD OF DRIVING A DISPLAY APPARATUS

CROSS-REFERENCE TO RELATED APPLICATION

This application claims priority under 35 USC § 119 to Korean Patent Application No. 10-2015-0138366, filed on Oct. 1, 2015 in the Korean Intellectual Property Office (KIPO), the contents of which are herein incorporated by reference in their entirety.

FIELD

The inventive concept relates to a method of driving a display apparatus. More particularly, exemplary embodiments relate to a method of driving a display apparatus displaying an image with a luminance adapted to a dark environment.

DISCUSSION OF RELATED ART

In a display apparatus, reducing the luminance of an image to be displayed in a dark environment may alleviate user eye fatigue and conserve energy. The luminance of a displayed image may be reduced by controlling backlight dimming based on the output of an illuminance sensor. If display luminance is reduced beyond a limit by backlight dimming, user recognition of a displayed image may be impaired.

SUMMARY

The present inventive concept provides a display apparatus and method for displaying a reduced luminance image in darker environments while substantially maintaining user recognition of the displayed image.

An exemplary embodiment provides a method of driving a display apparatus capable of displaying a reduced luminance image in a dark environment.

According to an exemplary embodiment method of driving a display apparatus, an outside illuminance is sensed by an illuminance sensor. At least one first color subpixel of a plurality of first color subpixels is disabled. Remaining first color subpixels are enabled based on the sensed outside illuminance. The first color subpixels corresponding to a first color are arranged along a first direction and a second direction crossing the first direction. An image is displayed on the remaining enabled first color subpixels.

In disabling the at least one first color subpixel and enabling the remaining first color subpixels, first color subpixels arranged in a first row extending in the first direction may be enabled. First color subpixels arranged in a second row adjacent to the first row may be disabled.

In disabling the at least one first color subpixel and enabling the remaining first color subpixels, first color subpixels arranged in a first column extending the second direction may be enabled. First color subpixels arranged in a second column adjacent to the first column may be disabled.

In disabling the at least one first color subpixel and enabling the remaining first color subpixels, first color subpixels arranged in a first row extending the first direction may be disabled. First color subpixels arranged in a second row adjacent to the first row may be alternately enabled and off by turns.

In disabling the at least one first color subpixel and enabling the remaining first color subpixel, first color subpixels arranged in a first column extending in the second direction may be disabled. First color subpixels arranged in a second column adjacent to the first column may be alternately enabled and off.

In disabling the at least one first color subpixel and enabling the remaining first color subpixels, first color subpixels may be alternately enabled and off in a first region along the first and second directions such that the enabled and disabled first color subpixels in the first region are arranged in a checker board pattern.

In an exemplary embodiment, the display apparatus may operate based on one of a column inversion driving scheme, a row inversion driving scheme, or a dot inversion driving scheme.

In an exemplary embodiment, grayscales of the first color subpixels may further be corrected based on the sensed outside illuminance. In displaying the image on the remaining enabled first color subpixels, the image may be displayed on the remaining enabled first color subpixels base on the corrected grayscales of the first color subpixels.

In correcting the grayscales of the first color subpixels, the grayscales of the first color subpixels may be converted into first luminance values of the first color subpixels. The first luminance values of the first color subpixels may be changed into second luminance values of the first color subpixels. The corrected grayscales of the first color subpixels may be generated based on the second luminance values of the first color subpixels.

In changing the first luminance values of the first color subpixels into the second luminance values of the first color subpixels, an average value of first luminance values of first and second subpixels of the first color subpixels may be generated. The first and second subpixels may be adjacent to each other. A second luminance value of the first subpixel may be determined as the average value. A second luminance value of the second subpixel may be determined as a minimum value. The first subpixel may be enabled. The second subpixel may be disabled.

In changing the first luminance values of the first color subpixels into the second luminance values of the first color subpixels, an average value of first luminance values of first to fourth subpixels of the first color subpixels may be generated. The first to fourth subpixels may be adjacent to one another. A second luminance value of the first subpixel may be determined as the average value. Second luminance values of the second to fourth subpixels of the first color subpixels may be determined as a minimum value. The first subpixel may be enabled. The second to fourth subpixels may be disabled.

In changing the first luminance values of the first color subpixels into the second luminance values of the first color subpixels, a weighted average value of first luminance values of first and second subpixels of the first color subpixels may be generated. The first and second subpixels may be adjacent to each other. A second luminance value of the first subpixel may be determined as the weighted average value. A second luminance value of the second subpixel may be determined as a minimum value. The first subpixel may be enabled. The second subpixel may be disabled.

In changing the first luminance values of the first color subpixels into the second luminance values of the first color subpixels, a weighted average value of first luminance values of first to fourth subpixels of the first color subpixels may be generated. The first to fourth subpixels may be adjacent to one another. A second luminance value of the first subpixel may be determined as the weighted average value. Second luminance values of the second to fourth subpixels of the first color subpixels may be determined as a minimum value. The first subpixel may be enabled. The second to fourth subpixels may be disabled.

In an exemplary embodiment, at least one second color subpixel of a plurality of second color subpixels may further be disabled. Remaining second color subpixels may be enabled based on the sensed outside illuminance. The second color subpixels corresponding to a second color may be arranged along the first and second directions. Each of the second color subpixels may be adjacent to a respective one of the first color subpixels. An image may be displayed on the remaining enabled second color subpixels.

In disabling the at least one first color subpixel and enabling the remaining first color subpixels, first color subpixels arranged in a first column extending the second direction may be enabled. First color subpixels arranged in a second column adjacent to the first column may be disabled. In disabling the at least one second color subpixel and enabling the remaining second color subpixels, second color subpixels arranged in a third column extending the second direction may be enabled. Second color subpixels arranged in a fourth column extending the second direction adjacent to the third column may be disabled.

In disabling the at least one first color subpixel and enabling the remaining first color subpixels, first color subpixels arranged in a first column extending the second direction may be enabled. First color subpixels arranged in a second column adjacent to the first column may be disabled. In disabling the at least one second color subpixel and enabling the remaining second color subpixels, the second color subpixels may be alternately enabled and off in a second region along the first and second direction such that the enabled and disabled second color subpixels in the second region are arranged in a checker board pattern.

In disabling the at least one first color subpixel and enabling the remaining first color subpixels, the first color subpixels may be alternately enabled and off in a third region along the first and second directions. In disabling the at least one second color subpixel and enabling the remaining second color subpixels, the second color subpixels may be alternately enabled and off in a fourth region along the first and second directions. The enabled and disabled first color subpixels in the third region may be arranged in a checker board pattern. The enabled and disabled second color subpixels in the fourth region may be arranged in a checker board pattern.

In an exemplary embodiment, the first color may be red or blue. The second color may be green.

In an exemplary embodiment, the number of the disabled first color subpixels may increase as a level of the sensed outside illuminance decreases.

In an exemplary embodiment, a dimming level for driving a backlight unit may further be generated based on the sensed outside illuminance. A light driving signal may be generated based on the dimming level and driving the backlight unit by using the light driving signal. A level of a luminance of a light generated by the backlight unit may decrease as a level of the sensed outside illuminance decreases.

According to a method of driving a display apparatus, a portion of subpixels may be disabled in a dark environment such that the display apparatus displays an image with a low luminance. In particular, OPR (on pixel ratio) may be controlled such that the display apparatus displays the image with the low luminance.

In an exemplary embodiment method, a ratio of enabled first color subpixels to total first color subpixels is different than a ratio of enabled second color subpixels to total second color subpixels.

An exemplary embodiment method further includes disabling at least one third color subpixel of a plurality of third color subpixels and enabling remaining third color subpixels of the plurality based on the sensed outside illuminance, the third color subpixels corresponding to a third color arranged along the first and second directions, each of the third color subpixels adjacent to a respective one of the second color subpixels; and displaying an image on the enabled third color subpixels.

In an exemplary embodiment method, the first color is red, the second color is blue, and the third color is green.

In an exemplary embodiment method, a ratio of enabled to total first color subpixels is less than or equal to a ratio of enabled to total second color subpixels, and the ratio of enabled to total second color subpixels is less than or equal to a ratio of enabled to total third color subpixels.

An exemplary embodiment display apparatus includes: an illuminance sensor; an image processor coupled to the illuminance sensor, the image processor including a mode decision part and an on-pixel ratio controller coupled to the mode decision part; and a display panel including a plurality of pixels coupled to the image processor, each of the plurality of pixels including a plurality of subpixels of a corresponding plurality of colors, wherein the image processor is configured to disable at least one first subpixel of at least one of the plurality of colors and adjust the luminance of remaining subpixels of the at least one of the plurality of colors based on the illuminance sensor, the mode decision part, and the on-pixel ratio controller.

In an exemplary embodiment display apparatus, the image processor is configured to adjust the luminance of remaining subpixels of the at least one of the plurality of colors based on an average luminance of the subpixel to be disabled and at least one closest remaining subpixel of the same color.

In an exemplary embodiment display apparatus, a ratio of disabled subpixels to total subpixels for a first of the plurality of colors is different than a ratio of disabled subpixels to total subpixels for another of the plurality of colors.

In an exemplary embodiment display apparatus, the plurality of colors includes a first color of red, a second color of blue, and a third color of green.

In an exemplary embodiment display apparatus, a ratio of disabled to total subpixels for a first of the plurality of colors is greater than or equal to a ratio of disabled to total subpixels for a second of the plurality of colors, and the ratio of disabled to total subpixels for the second of the plurality of colors is greater than or equal to a ratio of disabled to total subpixels for a third of the plurality of colors.

Accordingly, user eye fatigue may be minimized, power consumption may be reduced, and recognition of a displayed image may be maintained.

BRIEF DESCRIPTION OF THE DRAWINGS

Illustrative, non-limiting exemplary embodiments will be more clearly understood from the following detailed description taken in conjunction with the accompanying drawings.

DETAILED DESCRIPTION

Figure 1:
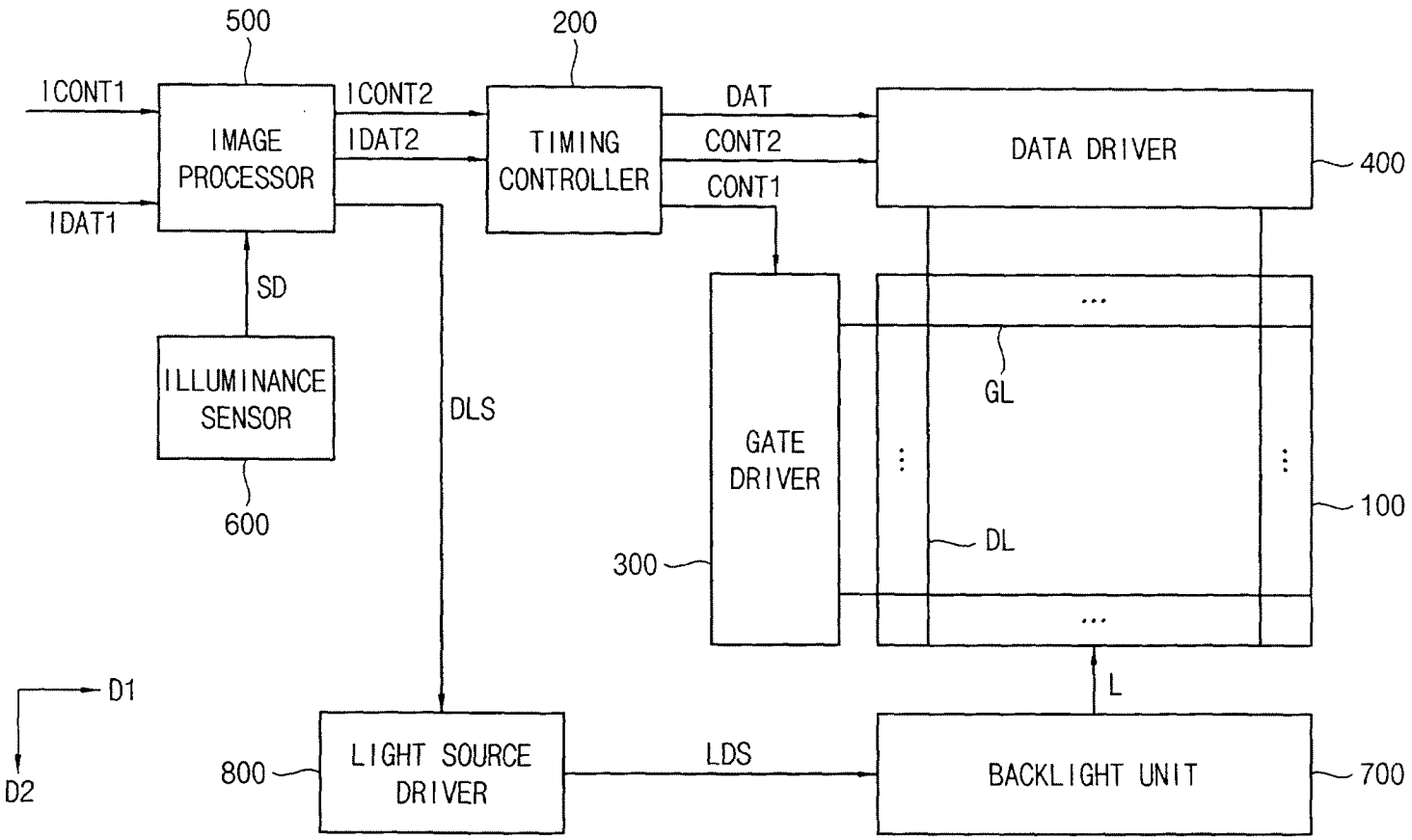
FIG. 1 is a block diagram illustrating a display apparatus according to an exemplary embodiment.

The inventive concept will be described more fully by way of example with reference to the accompanying drawings, in which exemplary embodiments are shown. This inventive concept may, however, be embodied in many different forms and should not be construed as limited to the embodiments set forth herein. Rather, these embodiments are provided so that this disclosure will be thorough and complete, and will fully convey the scope of the inventive concept to those skilled in the art. Like reference numerals may refer to like elements throughout this application.

Figure 2:
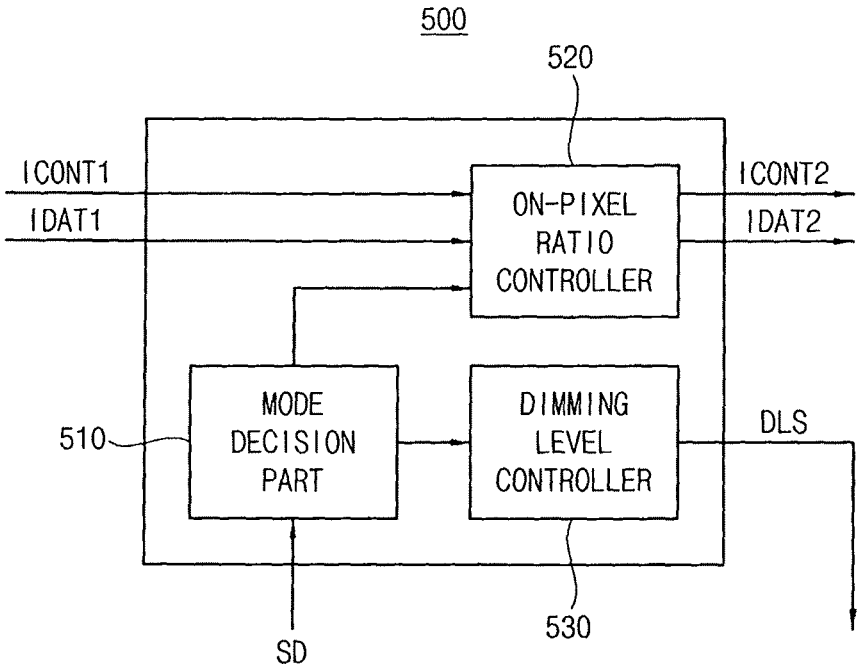
FIG. 2 is a block diagram illustrating an image processor included in the display apparatus of FIG. 1.

FIG. 1 is a block diagram illustrating a display apparatus according to an exemplary embodiment. FIG. 2 is a block diagram illustrating an image processor included in the display apparatus of FIG. 1.

Referring to FIGS. 1 and 2, a display apparatus 10 includes a display panel 100, a timing controller 200, a gate driver 300 connected between the timing controller and the display panel, a data driver 400 connected between the timing controller and the display panel, an image processor 500 connected to the timing controller, an illuminance sensor 600 connected to the timing controller, a backlight unit 700 connected to the display panel and a light source driver 800 connected between the image processor and the backlight unit.

The display panel 100 is connected to a plurality of gate lines GL and a plurality of data lines DL. The display panel 100 displays an image represented by a plurality of grayscales based on output image data DAT. The gate lines GL may extend in a first direction D1, and the data lines DL may extend in a second direction D2 crossing (e.g., substantially perpendicular to) the first direction D1.

The display panel 100 may include a plurality of pixels that are arranged in a matrix form. Each pixel may be electrically connected to a respective one of the gate lines GL and a respective one of the data lines DL.

In an exemplary embodiment, each pixel may include a switching element (not illustrated), a liquid crystal capacitor (not illustrated) and a storage capacitor (not illustrated). The liquid crystal capacitor and the storage capacitor may be electrically connected to the switching element. For example, the switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

In an exemplary embodiment, each pixel may include a plurality of subpixels. For example, each pixel may include first to third color subpixels. For example, the first color subpixel may be a red color subpixel. The second color subpixel may be a blue color subpixel. The third color subpixel may be a green color subpixel.

The timing controller 200 controls an operation of the display panel 100 and controls operations of the gate driver 300 and the data driver 400. The timing controller 200 receives a second input image data IDAT2 and a second input control signal ICONT2 from the image processor 500. The second input image data IDAT2 may include a plurality of corrected input pixel data for the plurality of pixels. The input pixel data may include a corrected first color grayscale data, a corrected second color grayscale data and a corrected third color grayscale data. The second input control signal ICONT2 may include a corrected master clock signal, a corrected data enable signal, a corrected vertical synchronization signal, a corrected horizontal synchronization signal, etc.

The timing controller 200 generates the output image data DAT, a first control signal CONT1 and a second control signal CONT2 based on the second input image data IDAT2 and the second input control signal ICONT2.

In particular, the timing controller 200 may generate the output image data DAT based on the second input image data IDAT2. The output image data DAT may be provided to the data driver 400. The timing controller 200 may generate the first control signal CONT1 based on the second input control signal ICONT2. The first control signal CONT1 may be provided to the gate driver 300, and a driving timing of the gate driver 300 may be controlled based on the first control signal CONT1. The first control signal CONT1 may include a vertical start signal, a gate clock signal, etc. The timing controller 200 may generate the second control signal CONT2 based on the second input control signal ICONT2. The second control signal CONT2 may be provided to the data driver 400, and a driving timing of the data driver 400 may be controlled based on the second control signal CONT2. The second control signal CONT2 may include a horizontal start signal, a data clock signal, a data load signal, a polarity control signal, etc.

The gate driver 300 receives the first control signal CONT1 from the timing controller 200. The gate driver 300 generates a plurality of gate signals for driving the gate lines GL based on the first control signal CONT1. The gate driver 300 may sequentially apply the gate signals to the gate lines GL.

The data driver 400 receives the second control signal CONT2 and the output image data DAT from the timing controller 200. The data driver 400 generates a plurality of analog data voltages based on the second control signal CONT2 and the digital output image data DAT. The data driver 400 may apply the data voltages to the data lines DL.

In an exemplary embodiment, the data driver 400 may include a shift register (not illustrated), a latch (not illustrated), a signal processor (not illustrated) and a buffer (not illustrated). The shift register may output a latch pulse to the latch. The latch may temporarily store the output image data, and may output the output image data to the signal processor. The signal processor may generate the analog data voltages based on the digital output image data and may output the analog data voltages to the buffer. The buffer may output the analog data voltages to the data lines DL.

In an exemplary embodiment, the gate driver 300 and/or the data driver 400 may be disposed, e.g., directly mounted, on the display panel 100, or may be connected to the display panel 100 in a tape carrier package (TCP) type or a chip on film (COF) type. Alternatively, the gate driver 300 and/or the data driver 400 may be integrated on the display panel 100.

The image processor 500 may include a mode decision part 510 determining a driving mode based on an outside illuminance SD, an on-pixel ratio controller 520 selecting a subpixel which is to be enabled or disabled, and performing a subpixel rendering to a luminance; and a dimming level controller 530 controlling a dimming level of the backlight unit 700 according to the driving mode determined by the mode decision part 510. It shall be understood that although the resulting ratio of disabled to total subpixels of a given color is necessarily a rational number, that the on-pixel ratio controller is not limited to disabling subpixels at fixed intervals, and may, for example, use an irrational number as an increment with rounding where appropriate. Exemplary embodiments illustrate fixed integer increments between disabled subpixels for ease of illustration.

For example, when the outside illuminance SD is equal to or more than a first reference illuminance (for example, 50 lux), the mode decision part 510 may determine the driving mode as a first driving mode. In the first driving mode, the display apparatus may control the dimming level of the backlight unit 700 to adjust a luminance by the dimming level controller 530.

In addition, when the outside illuminance SD is within a range of the first reference illuminance to a second reference illuminance (for example, 10 lux), the mode decision part 510 may determine the driving mode as a second driving mode. In the second driving mode, the display apparatus may control the dimming level of the backlight unit 700 by the dimming level controller 530, and half, for example, of all subpixels may be disabled by the on-pixel ratio controller 520.

When the outside illuminance SD is less than the second reference illuminance, the mode decision part 510 may determine the driving mode as a third driving mode. In the third driving mode, the display apparatus may control the dimming level of the backlight unit 700 by the dimming level controller 530, and three fourths, for example, of all subpixels may be disabled by the on-pixel ratio controller 520.

The on-pixel ratio controller 520 receives first input image data IDAT1 and a first input control signal ICONT1 from an external device. The first input image data IDAT1 may include a plurality of input pixel data for the plurality of pixels. The input pixel data may include first color grayscale data, second color grayscale data and third color grayscale data. For example, the first color may be red, the second color may be blue, and the third color may be green. The first input control signal ICONT1 may include a master clock signal, a data enable signal, a vertical synchronization signal, a horizontal synchronization signal, etc.

The on-pixel ratio controller 520 may correct the first input image data IDAT1 and a first input control signal ICONT1 to generate the second input image data IDAT2 and the second input control signal ICONT 2.

The on-pixel ratio controller 520 may receive the driving mode determined by the mode decision part 510, and the on-pixel ratio controller 520 may generate the corrected first color grayscale data of the first color subpixels included in the first input image data IDAT1 to generate the second input image data IDAT2.

In addition, the on-pixel ratio controller 520 may correct the first input control signal ICONT1 to generate the second input control signal ICONT2 such that at least one first color subpixel is disabled and remaining first color subpixels are enabled.

In particular, the on-pixel ratio controller 520 may convert the first color grayscale data of the first color subpixels into first luminance values and may change the first luminance values into second luminance values. The on-pixel ratio controller 520 may convert the second luminance values of the first color subpixels into corrected first color grayscale data.

For example, an average value of the first luminance values of first and second subpixels of the first color subpixels adjacent to each other may be generated, and a second luminance value of the first subpixel may be set to the average value. A second luminance value of the second subpixel may be set to a minimum value such as zero. The first subpixel may be enabled with the average value, and the second subpixel may be disabled with a minimum or zero value.

Alternatively, an average value of the first luminance values of first to fourth subpixels of the first color subpixels adjacent to one another may be generated, and a second luminance value of the first subpixel may be set to the average value. Second luminance values of the second to fourth subpixels may be set to a minimum value such as zero. The first subpixel may be enabled with the average value, and the second to fourth subpixels may be disabled with a minimum or zero value.

The dimming level controller 530 may output a dimming level signal DLS to the light source driver 800 based on the driving mode determined by the mode decision part 510. For example, when the outside illuminance SD is low, the dimming level controller 530 may output the dimming level signal DLS such that a luminance generated by the backlight unit 700 is low.

The illuminance sensor 600 may sense the outside illuminance SD, and may output the sensed outside illuminance SD to the mode decision part 510 of the image processor 500.

The light source driver 800 may receive the dimming level signal DLS from the dimming level controller 530 of the image processor 500, and may output a light source driving signal LDS to the backlight unit 700.

The backlight unit 700 may receive the light source driving signal LDS from the light source driver 800, and may generate a light L toward the display panel 100.

Figure 3:
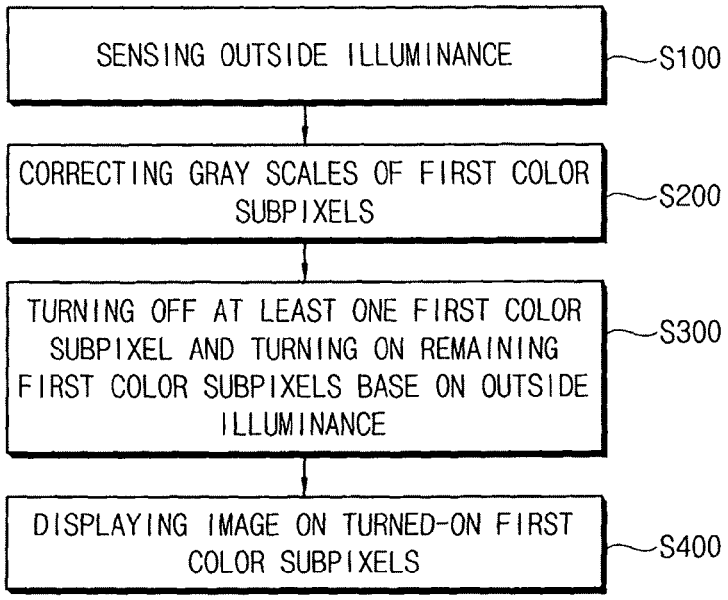
FIG. 3 is a flow chart illustrating a method of driving a display apparatus.
Figure 4:
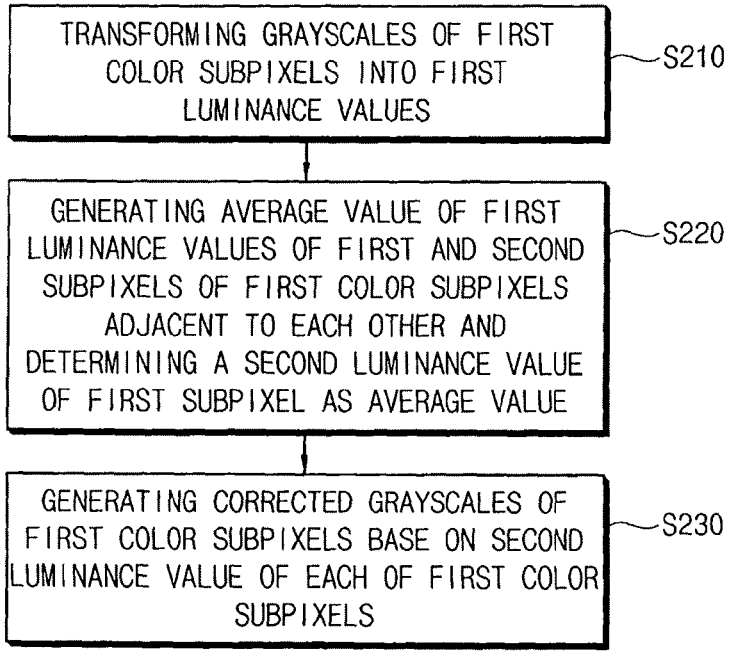
FIG. 4 is a flow chart illustrating an example of correcting grayscales of first color subpixels according to an exemplary embodiment.
Figure 15:
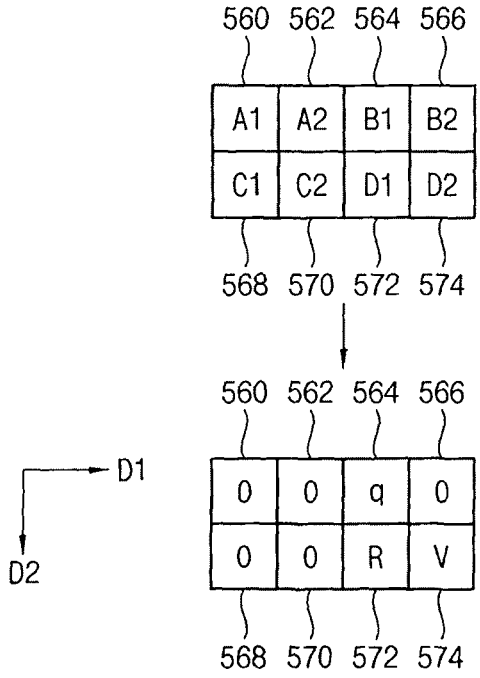
FIGS. 15 and 16 are hybrid diagrams illustrating an example of a subpixel rendering for luminance values of first and second color subpixels and disabling a portion of the first and second color subpixels.
Figure 16:
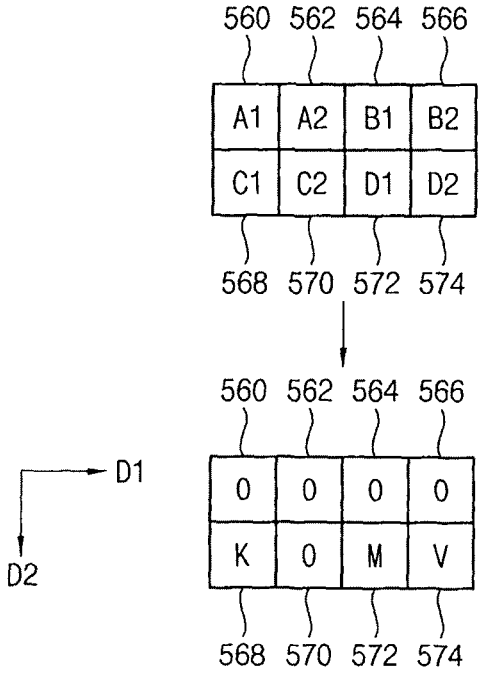
Figure 17:
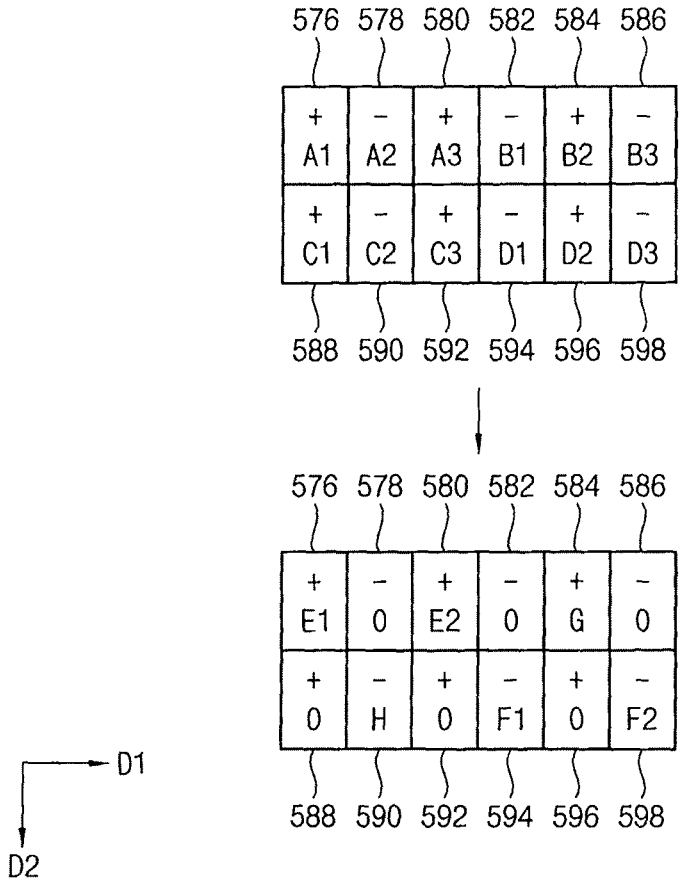
FIGS. 17 and 18 are hybrid diagrams illustrating an example of a subpixel rendering for luminance values of first to third color subpixels and disabling a portion of the first to third color subpixel in a column inversion driving scheme.
Figure 18:
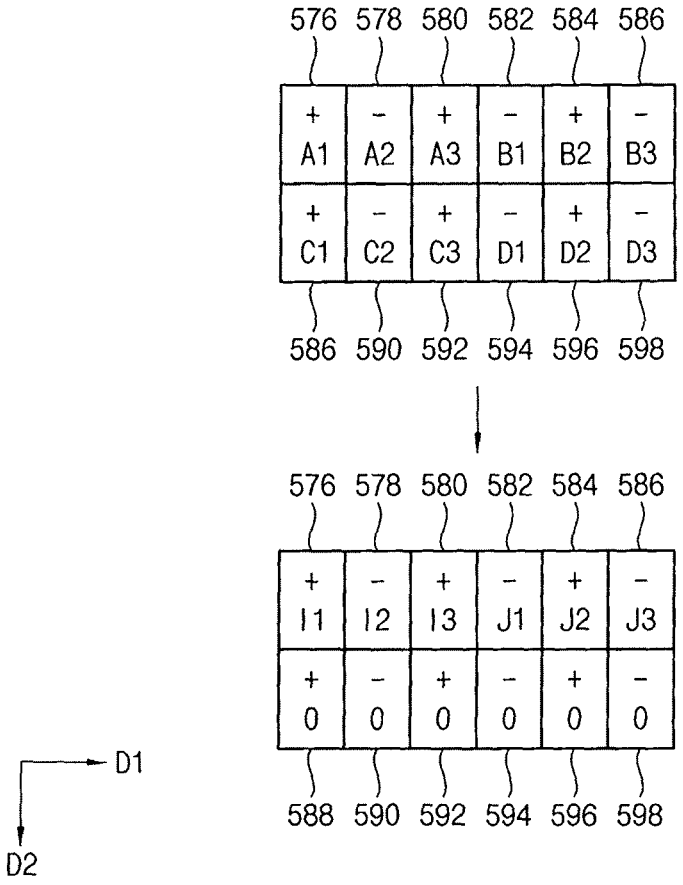
Figure 19:
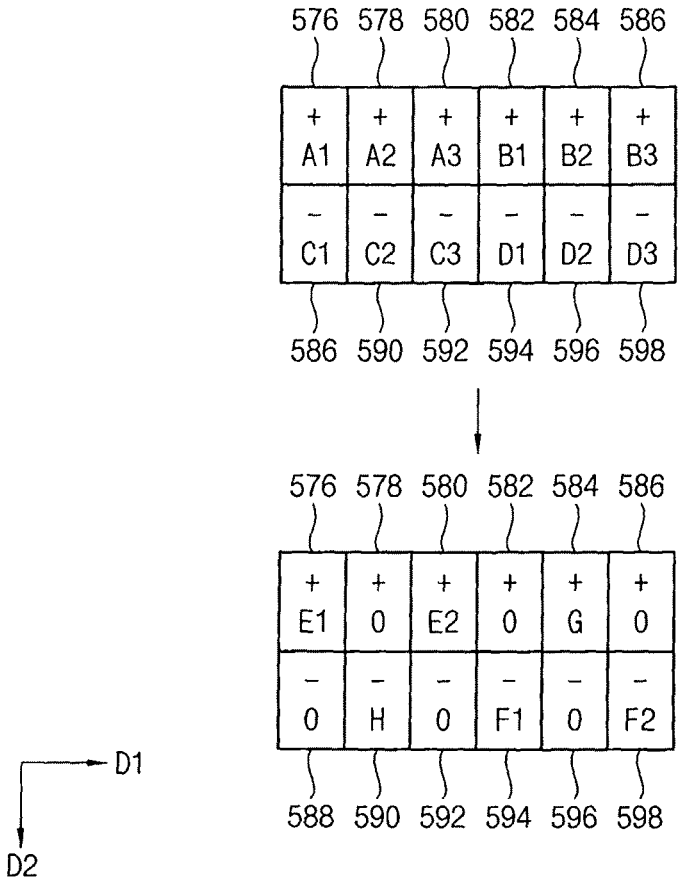
FIGS. 19 and 20 are hybrid diagrams illustrating an example of a subpixel rendering for luminance values of first to third color subpixels and disabling a portion of the first to third color subpixel in a row inversion driving scheme.
Figure 20:
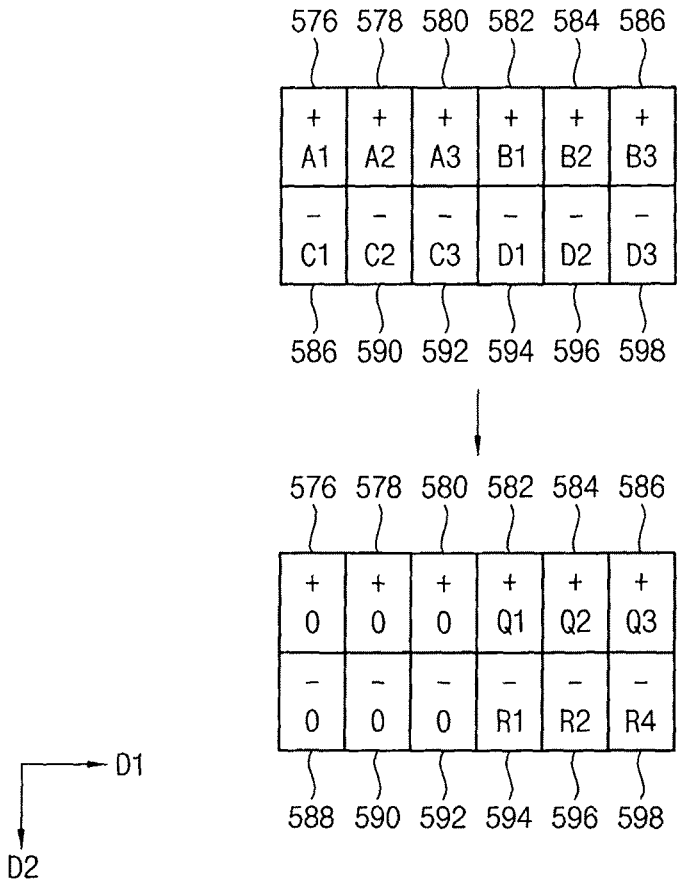
Figure 21:
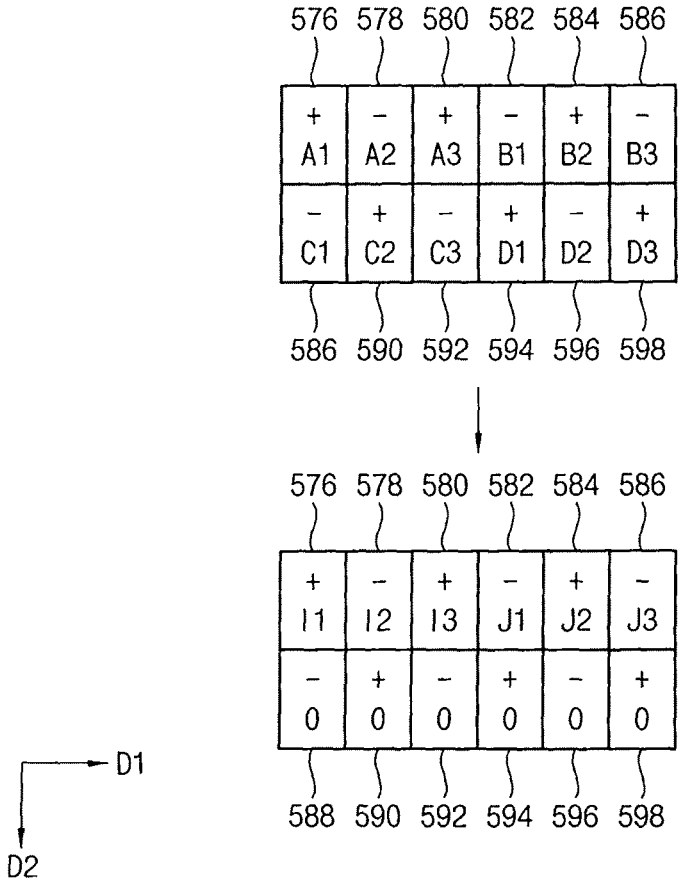
FIGS. 21 and 22 are hybrid diagrams illustrating an example of a subpixel rendering for luminance values of first to third color subpixels and disabling a portion of the first to third color subpixel in a dot inversion driving scheme.
Figure 22:
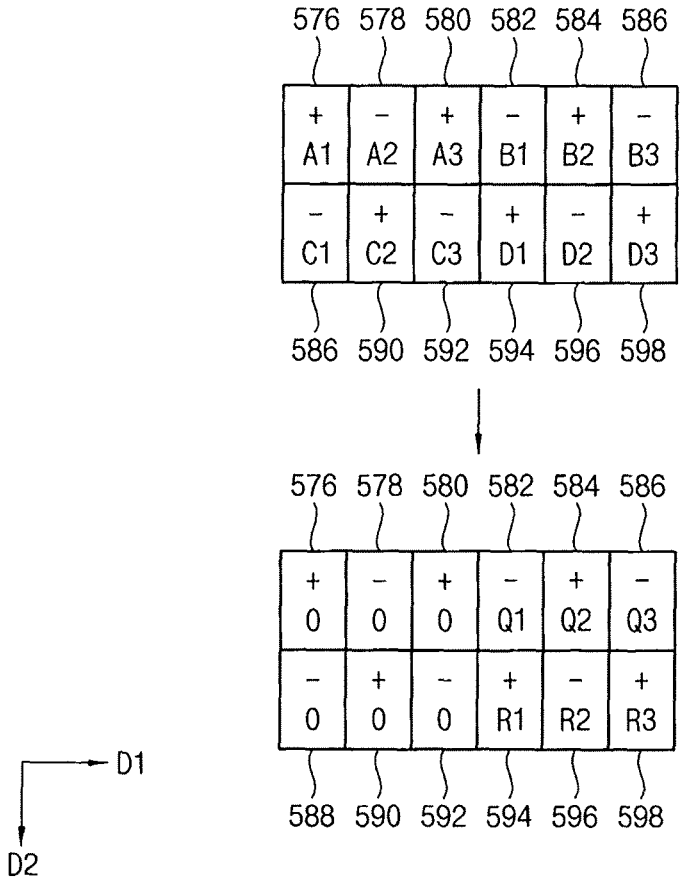

Hereinafter, a method of driving a display apparatus will be explained in detail. FIG. 3 is a flow chart illustrating a method of driving a display apparatus. FIG. 4 is a flow chart illustrating an example of correcting grayscales of first color subpixels according to an exemplary embodiment. FIGS. 5 to 14 are figures illustrating an example of a subpixel rendering for luminance values of first color subpixels and disabling a portion of the first color subpixels. FIGS. 15 and 16 are figures illustrating an example of a subpixel rendering for luminance values of first and second color subpixels and disabling a portion of the first and second color subpixels. FIGS. 17 and 18 are figures illustrating an example of a subpixel rendering for luminance values of first to third color subpixels and disabling a portion of the first to third color subpixel in a column inversion driving scheme. FIGS. 19 and 20 are figures illustrating an example of a subpixel rendering for luminance values of first to third color subpixels and disabling a portion of the first to third color subpixel in a row inversion driving scheme. FIGS. 21 and 22 are figures illustrating an example of a subpixel rendering for luminance values of first to third color subpixels and disabling a portion of the first to third color subpixel in a dot inversion driving scheme.

Referring to FIGS. 1 to 4, an outside illuminance SD is sensed by using an illuminance sensor 600 (S100).

Grayscale data of a plurality of first color subpixels may be corrected based on the sensed outside illuminance SD (S200). A display apparatus may include a plurality of pixels. Each of pixels may include a plurality of subpixels. For example, each of the pixels may include a first color subpixel, a second color subpixel and a third color subpixel. For example, the first color subpixel may be a red subpixel. The second color subpixel may be a blue subpixel. The third color subpixel may be a green subpixel. The pixels may be arranged along a first direction D1, and a second direction D2 crossing the first direction D1.

In an exemplary embodiment, the grayscale data of the first color subpixels may be converted into first luminance values of the first color subpixels (S210). An average value of first luminance values of first and second subpixels of the first color subpixels adjacent to each other may be generated, and the second luminance value of the first subpixel may be determined as the average value. The second luminance value of the second subpixel may be determined as a minimum (S220).

Corrected grayscale data of the first color subpixels based on the second luminance values of the first color subpixels may be generated (S230).

At least one first color subpixel may be disabled and remaining first color subpixels may be enabled based on the sensed outside illuminance SD (S300). For example, the first subpixel may be enabled, and the second subpixel may be disabled.

Alternatively, first to fourth subpixels of the first color subpixels adjacent to one another may be enabled or disabled based on the sensed outside illuminance SD along the first and second direction D1 and D2, by turns. For example, the first to fourth subpixels may be enabled or disabled in a checker board pattern.

An image is displayed on the enabled first color subpixels (S400).

Figure 5:
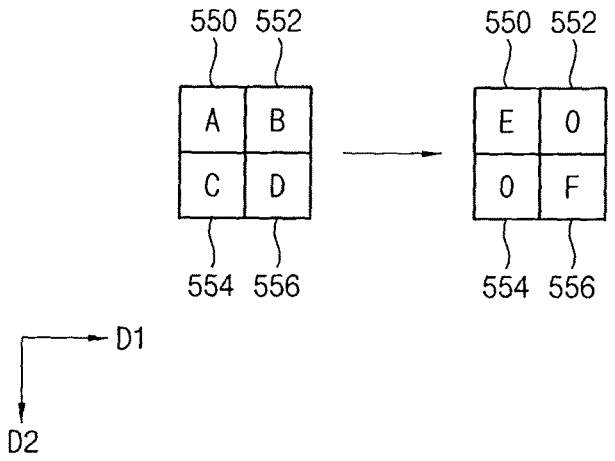
FIGS. 5 to 14 are hybrid diagrams illustrating an example of a subpixel rendering for luminance values of first color subpixels and disabling a portion of the first color subpixels.

Referring to FIG. 5, each of grayscale data of first to fourth subpixels 550, 552, 554 and 556 of the first color subpixels adjacent to one another may be converted into a respective one of first luminance values A, B, C and D.

For example, each of grayscale data of first to fourth subpixels 550, 552, 554 and 556 may be converted into a respective one of first luminance values A, B, C and D by using a predetermined gamma curve including a relationship between a luminance and a grayscale.

The first luminance value A of the first subpixel 550 may be changed into a second luminance value E, and the first luminance value D of the fourth subpixel 556 may be changed into a second luminance value F.

For example, the second luminance value E may be an average value of the first luminance values A and B, and the second luminance value F may be an average value of the first luminance values C and D. Alternatively, the second luminance value E may be an average value of the first luminance values A and C, and the second luminance value F may be an average value of the first luminance values B and D. Alternatively, the second luminance value E may an average value of the first luminance values A, B and two first luminance values of the first color subpixels (not shown) which are disposed at upper portions of the first and second subpixels 550 and 552, and the second luminance value F may be an average value of the first luminance values A, B, C and D.

In addition, the second subpixel 552 having the first luminance value B and the second subpixel 554 having the first luminance value C may be disabled, and the first and fourth subpixels 550 and 556 may be enabled.

Figure 6:
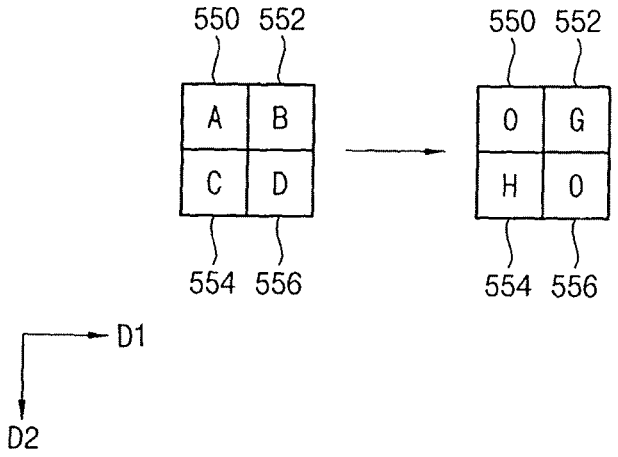

Referring to FIG. 6, the first luminance value B of the first subpixel 552 may be changed into a second luminance value G, and the first luminance value C of the third subpixel 554 may be changed into a second luminance value H.

For example, the second luminance value G may be an average value of the first luminance values A and B, and the second luminance value H may be an average value of the first luminance values C and D. Alternatively, the second luminance value G may be an average value of the first luminance values A and C, and the second luminance value H may be an average value of the first luminance values B and D. Alternatively, the second luminance value G may an average value of the first luminance values A, B and two first luminance values of the first color subpixels (not shown) which are disposed at upper portions of the first and second subpixels 550 and 552, and the second luminance value H may be an average value of the first luminance values A, B, C and D.

In addition, the first subpixel 550 having the first luminance value A and the fourth subpixel 556 having the first luminance value D may be disabled, and the second and third subpixels 552 and 554 may be enabled.

Figure 7:
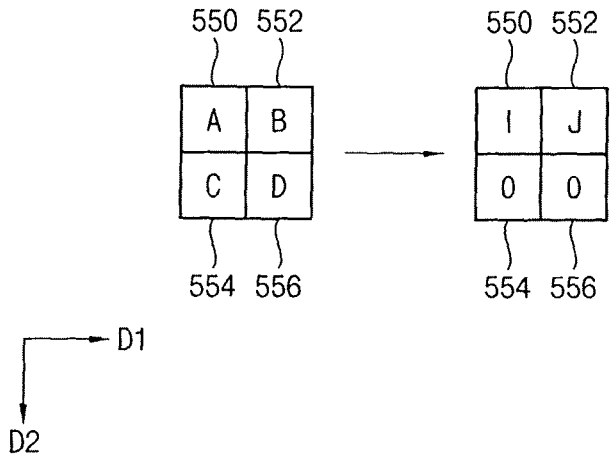

Referring to FIG. 7, the first luminance value A of the first subpixel 550 may be changed into a second luminance value I, and the first luminance value B of the second subpixel 552 may be changed into a second luminance value J. For example, the second luminance value I may be an average value of the first luminance values A and C, and the second luminance value J may be an average value of the first luminance values B and D.

In addition, the first and second subpixels 550 and 552 arranged in a first row extending the first direction D1 may be enabled, and the third and fourth subpixels 554 and 556 arranged in a second row extending the first direction adjacent to the first row may be disabled.

Figure 8:
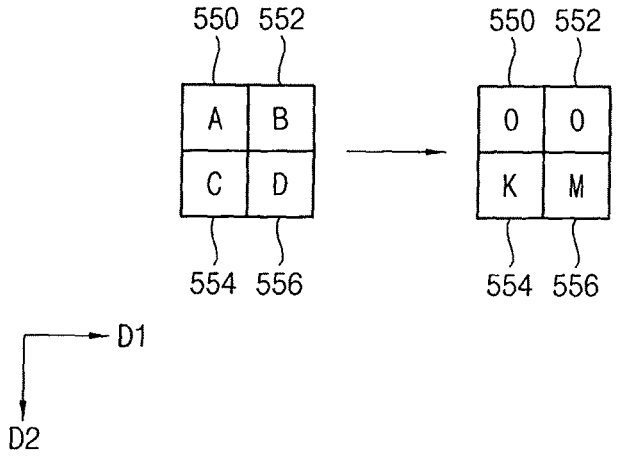

Referring to FIG. 8, the first luminance value C of the third subpixel 554 may be changed into a second luminance value K, and the first luminance value D of the fourth subpixel 556 may be changed into a second luminance value M. For example, the second luminance value K may be an average value of the first luminance values A and C, and the second luminance value M may be an average value of the first luminance values B and D.

In addition, the first and second subpixels 550 and 552 arranged in the first row extending the first direction D1 may be disabled, and the third and fourth subpixels 554 and 556 arranged in the second row extending the first direction D1 adjacent to the first row may be enabled.

Figure 9:
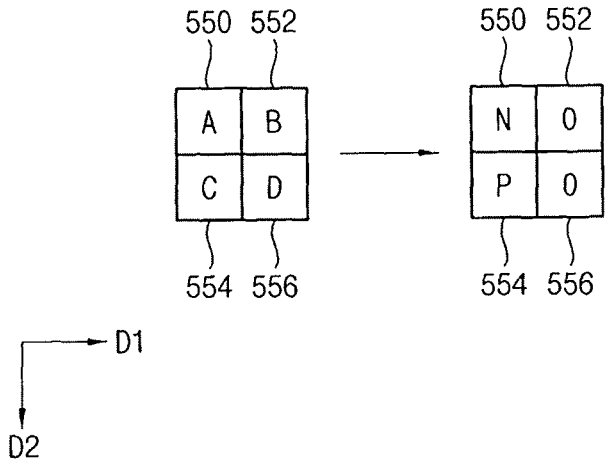

Referring to FIG. 9, the first luminance value A of the first subpixel 550 may be changed into a second luminance value N, and the first luminance value C of the third subpixel 554 may be changed into a second luminance value P. For example, the second luminance value N may be an average value of the first luminance values A and B, and the second luminance value P may be an average value of the first luminance values C and D.

In addition, the first and third subpixels 550 and 554 arranged in a first column extending the second direction D2 may be enabled, and the second and fourth subpixels 552 and 556 arranged in a second column extending the second direction D2 adjacent to the first column may be disabled.

Figure 10:
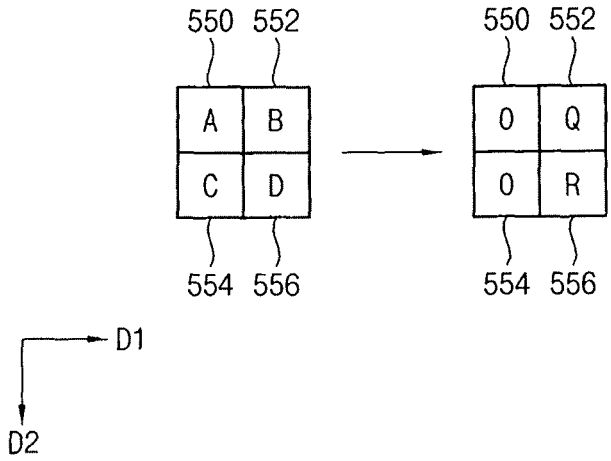

Referring to FIG. 10, the first luminance value B of the second subpixel 552 may be changed into a second luminance value Q, and the first luminance value D of the fourth subpixel 556 may be changed into a second luminance value R. For example, the second luminance value Q may be an average value of the first luminance values A and B, and the second luminance value R may be an average value of the first luminance values C and D.

In addition, the first and third subpixels 550 and 554 arranged in the first column extending the second direction D2 may be disabled, and the second and fourth subpixels 552 and 556 arranged in the second column extending the second direction D2 adjacent to the first column may be enabled.

Figure 11:
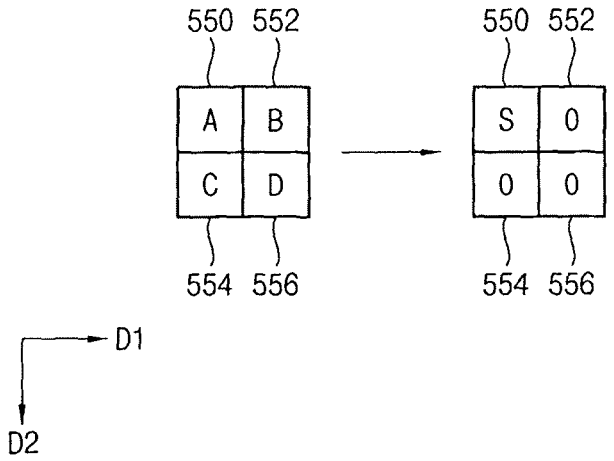

Referring to FIG. 11, the first luminance value A of the first subpixel 550 may be changed into a second luminance value S. For example, the second luminance value S may be an average value of the first luminance values A, B, C and D. Alternatively, the second luminance value S may be an added value of C multiplied by 0.25, D multiplied by 0.25 and A multiplied by 0.5. For example, the second luminance value S may be a weighted average of the first luminance values A, C and D.

In addition, the third and fourth subpixels 554 and 556 arranged in the second row may be disabled, and the first and second subpixels 550 and 552 arranged in the first row may be alternately enabled and off along the first direction D1.

Figure 12:
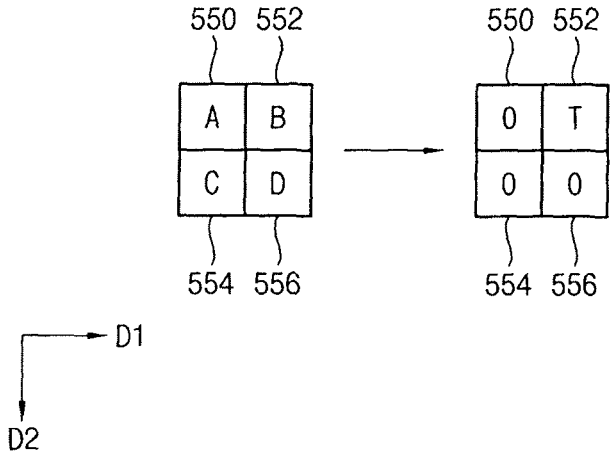

Referring to FIG. 12, the first luminance value B of the second subpixel 552 may be changed into a second luminance value T. For example, the second luminance value T may be an average value of the first luminance values A, B, C and D. Alternatively, the second luminance value T may be an added value of C multiplied by 0.25, D multiplied by 0.25 and B multiplied by 0.5. For example, the second luminance value T may be a weighted average of the first luminance values B, C and D.

In addition, the first and third subpixels 550 and 554 arranged in the first column may be disabled, and the second and fourth subpixels 552 and 556 arranged in the second column may be alternately enabled and off along the second direction D2.

Figure 13:
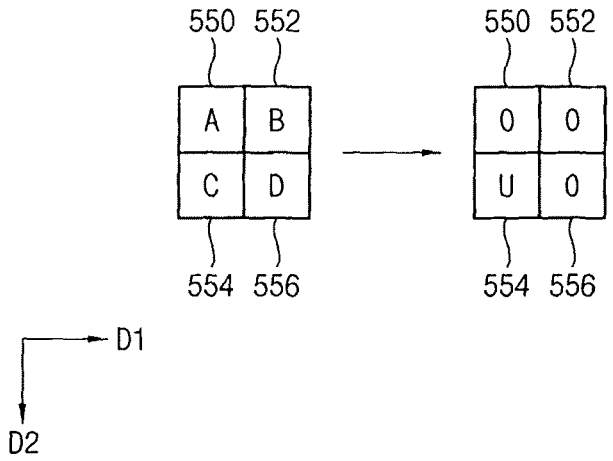

Referring to FIG. 13, the first luminance value C of the third subpixel 554 may be changed into a second luminance value U. For example, the second luminance value U may be an average value of the first luminance values A, B, C and D. Alternatively, the second luminance value U may be an added value of A multiplied by 0.25, B multiplied by 0.25 and C multiplied by 0.5. For example, the second luminance value U may be a weighted average of the first luminance values A, B and C.

In addition, the first and second subpixels 550 and 552 arranged in the first row may be disabled, and the third and fourth subpixels 554 and 556 arranged in the second row may be alternately enabled and off along the first direction D1.

Figure 14:
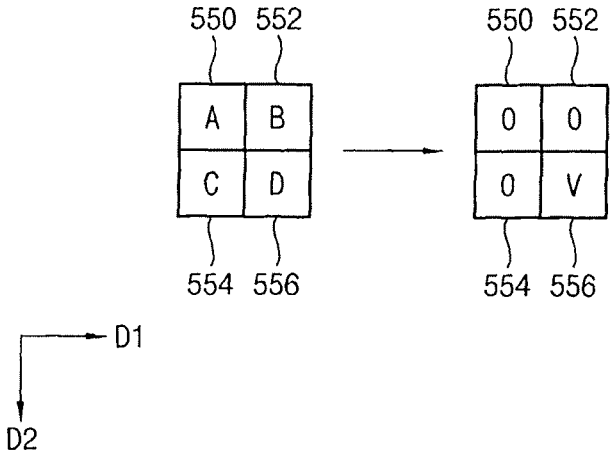

Referring to FIG. 14, the first luminance value D of the fourth subpixel 556 may be changed into a second luminance value V. For example, the second luminance value V may be an average value of the first luminance values A, B, C and D. Alternatively, the second luminance value V may be an added value of A multiplied by 0.25, B multiplied by 0.25 and D multiplied by 0.5. For example, the second luminance value V may be a weighted average of the first luminance values A, B and D.

In addition, the first and third subpixels 550 and 554 arranged in the first column may be disabled, and the second and fourth subpixels 552 and 556 arranged in the second column may be alternately enabled and off along the second direction D2.

In example embodiment, at least one second color subpixel may be disabled, and remaining second color subpixels may be enabled.

Referring to FIG. 15, each of pixels may include a plurality of first color subpixels 560, 564, 568, 572 and a plurality of second color subpixels 562, 566, 570 and 574.

For example, the first color subpixels 560, 564, 568 and 572 may correspond to a first color, and the second color subpixels 562, 566, 570 and 574 may correspond to a second color. For example, the first color subpixels 560, 564, 568 and 572 may be red or blue subpixels, and the second color subpixels 562, 566, 570 and 574 may be green subpixels.

As illustrated in FIG. 15, the first luminance value B1 of the first color subpixel 564 may be changed into a second luminance value Q, and the first luminance value D1 of the first color subpixel 572 may be changed into a second luminance value R. For example, the second luminance value Q may be an average value of the first luminance values A1 and B1, and the second luminance value R may be an average value of the first luminance values C1 and D1.

In addition, the first luminance value D2 of the second color subpixel 574 may be changed into a second luminance value V. For example, the second luminance value V may be an average value of the first luminance values A2, B2, C2 and D2. Alternatively, the second luminance value V may be an added value of A2 multiplied by 0.25, B2 multiplied by 0.25 and D2 multiplied by 0.5. For example, the second luminance value V may be a weighted average of the first luminance values A2, B2 and D2.

The first color subpixels 564 and 572 arranged in a third column extending the second direction D2 may be enabled, and the first color subpixels 560 and 568 arranged in a first column extending the second direction D2 may be disabled.

In addition, the second color subpixels 562 and 570 arranged in the second column may be disabled, and the second color subpixels 566 and 574 arranged in the fourth column may be alternately enabled and disabled along the second direction D2. Thus, a ratio of enabled first color subpixels to total first color subpixels may be different than a ratio of enabled second color subpixels to total second color subpixels, for example.

Referring to FIG. 16, the first luminance value C1 of the first color subpixel 558 may be changed into a second luminance value K1, and the first luminance value D1 of the first color subpixel 572 may be changed into a second luminance value M. For example, the second luminance value K may be an average value of the first luminance values A1 and C1, and the second luminance value M may be an average value of the first luminance values B1 and D1.

In addition, the first luminance value D2 of the second color subpixel 574 may be changed into a second luminance value V. For example, the second luminance value V may be an average value of the first luminance values A2, B2, C2 and D2. Alternatively, the second luminance value V may be an added value of A2 multiplied by 0.25, B2 multiplied by 0.25 and D2 multiplied by 0.5. For example, the second luminance value V may be a weighted average of the first luminance values A2, B2 and D2.

In addition, the first color subpixels 560 and 564 arranged in a first row extending the first direction D1 may be disabled, and the first color subpixels 568 and 572 arranged in a second row may be enabled.

In addition, the second color subpixels 562 and 570 arranged in the second column may be disabled, and the second color subpixels 566 and 574 arranged in the fourth column may be alternately enabled and off along the second direction D2.

Referring to FIG. 17, each of pixels may include a plurality of first color subpixels 576, 582, 588 and 594, a plurality of second color subpixels 578, 584, 590 and 596 and a plurality of third color subpixels 580, 586, 592 and 598.

For example, the first color subpixels may correspond to a first color, the second color subpixels may correspond to a second color and the third color subpixels may correspond to a third color. For example, the first color subpixels may be red subpixels, the second color subpixels may be blue subpixels, and the third color subpixels may be green subpixels.

As illustrated in FIG. 17, the pixels may be driven in a column inversion driving scheme. In particular, a positive voltage may be applied to subpixels in columns extending the second direction D2, or a negative voltage may be applied to subpixels in columns. The positive voltage and the negative voltage may be applied along the first direction D1, by turns.

The first luminance value A1 of the first color subpixel 576 may be changed into a second luminance value E1, and the first luminance value D1 of the first color subpixel 594 may be changed into a second luminance value F1.

The first luminance value A3 of the third color subpixel 580 may be changed into a second luminance value E2, and the first luminance value D3 of the third color subpixel 598 may be changed into a second luminance value F2.

For example, the second luminance value E1 may be an average value of the first luminance values A1 and B1, and the second luminance value F1 may be an average value of the first luminance values C1 and D1. Alternatively, the second luminance value E1 may be an average value of the first luminance values A1 and C1, and the second luminance value F1 may be an average value of the first luminance values B1 and D1. Alternatively, the second luminance value E1 may an average value of the first luminance values A1, B1 and two first luminance values of the first color subpixels (not shown) which are disposed at upper portions of the first color subpixels 576 and 582, and the second luminance value F1 may be an average value of the first luminance values A1, B1, C1 and D1.

For example, the second luminance value E2 may be an average value of the first luminance values A3 and B3, and the second luminance value F2 may be an average value of the first luminance values C3 and D3. Alternatively, the second luminance value E2 may be an average value of the first luminance values A3 and C3, and the second luminance value F2 may be an average value of the first luminance values B3 and D3. Alternatively, the second luminance value E2 may an average value of the first luminance values A3, B3 and two first luminance values of the third color subpixels (not shown) which are disposed at upper portions of the third color subpixels 580 and 586, and the second luminance value F2 may be an average value of the first luminance values A3, B3, C3 and D3.

The first luminance value B2 of the second color subpixel 584 may be changed into a second luminance value G, and the first luminance value C2 of the second color subpixel 590 may be changed into a second luminance value H.

For example, the second luminance value G may be an average value of the first luminance values A2 and B2, and the second luminance value H may be an average value of the first luminance values C2 and D2. Alternatively, the second luminance value G may be an average value of the first luminance values B2 and D2, and the second luminance value H may be an average value of the first luminance values A2 and C2. Alternatively, the second luminance value G may an average value of the first luminance values A2, B2 and two first luminance values of the second color subpixels (not shown) which are disposed at upper portions of the second color subpixels 578 and 584, and the second luminance value H may be an average value of the first luminance values A2, B2, C2 and D2.

The first color subpixels 576, 582, 588 and 594 may be alternately enabled and off along the first and second directions D1 and D2. The second color subpixels 578, 584, 590 and 596 may be alternately enabled and off along the first and second directions D1 and D2. The third color subpixels 580, 586, 592 and 598 may be alternately enabled and off along the first and second directions D1 and D2.

The first to third color subpixels may be alternately enabled and off in a checker board pattern with a predetermined width.

For example, the first color subpixels 576 and 594, the second color subpixels 584 and 590 and the third color subpixels 586 and 592 may be enabled. The first color subpixels 582 and 588, the second color subpixels 578 and 596 and the third color subpixels 586 and 592 may be disabled.

Referring to FIG. 18, the first luminance value A1 of the first color subpixel 576 may be changed into a second luminance value I1, and the first luminance value B1 of the first color subpixel 582 may be changed into a second luminance value J1. For example, the second luminance value I1 may be an average value of the first luminance values A1 and C1, and the second luminance value J1 may be an average value of the first luminance values B1 and D1.

The first luminance value A2 of the second color subpixel 578 may be changed into a second luminance value I2, and the first luminance value B2 of the second color subpixel 584 may be changed into a second luminance value J2. For example, the second luminance value I2 may be an average value of the first luminance values A2 and C2, and the second luminance value J2 may be an average value of the first luminance values B2 and D2.

The first luminance value A3 of the first color subpixel 580 may be changed into a second luminance value I3, and the first luminance value B3 of the third color subpixel 586 may be changed into a second luminance value J3. For example, the second luminance value I3 may be an average value of the first luminance values A3 and C3, and the second luminance value J3 may be an average value of the first luminance values B3 and D3.

In addition, the first color subpixels 556 and 582 arranged in the first row extending the first direction D1 may be enabled, and the first color subpixels 588 and 594 arranged in the second row extending the first direction adjacent to the first row may be disabled.

The second color subpixels 578 and 584 arranged in the first row extending the first direction D1 may be enabled, and the second color subpixels 590 and 596 arranged in the second row extending the first direction adjacent to the first row may be disabled.

The third color subpixels 580 and 586 arranged in the first row extending the first direction D1 may be enabled, and the third color subpixels 592 and 598 arranged in the second row extending the first direction adjacent to the first row may be disabled.

Referring to FIG. 19, the pixels may be driven in a row inversion driving scheme. In particular, a positive voltage may be applied to subpixels in rows extending the first direction D1, or a negative voltage may be applied to subpixels in rows. The positive voltage and the negative voltage may be applied along the second direction D2, by turns.

The first luminance value A1 of the first color subpixel 576 may be changed into a second luminance value E1, and the first luminance value D1 of the first color subpixel 594 may be changed into a second luminance value F1.

The first luminance value A3 of the third color subpixel 580 may be changed into a second luminance value E2, and the first luminance value D3 of the third color subpixel 598 may be changed into a second luminance value F2.

For example, the second luminance value E1 may be an average value of the first luminance values A1 and B1, and the second luminance value F1 may be an average value of the first luminance values C1 and D1. Alternatively, the second luminance value E1 may be an average value of the first luminance values A1 and C1, and the second luminance value F1 may be an average value of the first luminance values B1 and D1. Alternatively, the second luminance value E1 may an average value of the first luminance values A1, B1 and two first luminance values of the first color subpixels (not shown) which are disposed at upper portions of the first color subpixels 576 and 582, and the second luminance value F1 may be an average value of the first luminance values A1, B1, C1 and D1.

For example, the second luminance value E2 may be an average value of the first luminance values A3 and B3, and the second luminance value F2 may be an average value of the first luminance values C3 and D3. Alternatively, the second luminance value E2 may be an average value of the first luminance values A3 and C3, and the second luminance value F2 may be an average value of the first luminance values B3 and D3. Alternatively, the second luminance value E2 may an average value of the first luminance values A3, B3 and two first luminance values of the third color subpixels (not shown) which are disposed at upper portions of the third color subpixels 580 and 586, and the second luminance value F2 may be an average value of the first luminance values A3, B3, C3 and D3.

The first luminance value B2 of the second color subpixel 584 may be changed into a second luminance value G, and the first luminance value C2 of the second color subpixel 590 may be changed into a second luminance value H.

For example, the second luminance value G may be an average value of the first luminance values A2 and B2, and the second luminance value H may be an average value of the first luminance values C2 and D2. Alternatively, the second luminance value G may be an average value of the first luminance values B2 and D2, and the second luminance value H may be an average value of the first luminance values A2 and C2. Alternatively, the second luminance value G may an average value of the first luminance values A2, B2 and two first luminance values of the second color subpixels (not shown) which are disposed at upper portions of the second color subpixels 578 and 584, and the second luminance value H may be an average value of the first luminance values A2, B2, C2 and D2.

The first color subpixels 576, 582, 588 and 594 may be alternately enabled and off along the first and second directions D1 and D2. The second color subpixels 578, 584, 590 and 596 may be alternately enabled and off along the first and second directions D1 and D2. The third color subpixels 580, 586, 592 and 598 may be alternately enabled and off along the first and second directions D1 and D2.

The first to third color subpixels may be alternately enabled and off in a checker board pattern with a predetermined width.

For example, the first color subpixels 576 and 594, the second color subpixels 584 and 590 and the third color subpixels 586 and 592 may be enabled. The first color subpixels 582 and 588, the second color subpixels 578 and 596 and the third color subpixels 586 and 592 may be disabled.

Referring to FIG. 20, the first luminance value B1 of the first color subpixel 576 may be changed into a second luminance value Q1, and the first luminance value D1 of the first color subpixel 594 may be changed into a second luminance value R1. For example, the second luminance value Q1 may be an average value of the first luminance values A1 and B1, and the second luminance value R1 may be an average value of the first luminance values C1 and D1.

The first luminance value B2 of the second color subpixel 578 may be changed into a second luminance value Q2, and the first luminance value D2 of the second color subpixel 596 may be changed into a second luminance value R2. For example, the second luminance value Q2 may be an average value of the first luminance values A2 and B2, and the second luminance value R2 may be an average value of the first luminance values C2 and D2.

The first luminance value B3 of the third color subpixel 580 may be changed into a second luminance value Q3, and the first luminance value D3 of the second color subpixel 598 may be changed into a second luminance value R3. For example, the second luminance value Q3 may be an average value of the first luminance values A3 and B3, and the second luminance value R3 may be an average value of the first luminance values C3 and D3.

The first color subpixels 576 and 588 arranged in the first column extending the second direction D2 may be disabled, and the first color subpixels 582 and 594 arranged in the fourth column extending the second direction D2 may be enabled.

The second color subpixels 578 and 590 arranged in the second column extending the second direction D2 may be disabled, and the second color subpixels 584 and 596 arranged in the fifth column extending the second direction D2 may be enabled.

The third color subpixels 580 and 592 arranged in the third column extending the second direction D2 may be disabled, and the third color subpixels 586 and 598 arranged in the sixth column extending the second direction D2 may be enabled.

Referring to FIG. 21, the pixels may be driven in a dot inversion driving scheme. In particular, a positive voltage or a negative voltage may be applied to subpixels in the first and second directions, by turns.

The first luminance value A1 of the first color subpixel 576 may be changed into a second luminance value I1, and the first luminance value B1 of the first color subpixel 582 may be changed into a second luminance value J1. For example, the second luminance value I1 may be an average value of the first luminance values A1 and C1, and the second luminance value J1 may be an average value of the first luminance values B1 and D1.

The first luminance value A2 of the second color subpixel 578 may be changed into a second luminance value I2, and the first luminance value B2 of the second color subpixel 584 may be changed into a second luminance value J2. For example, the second luminance value J2 may be an average value of the first luminance values A2 and C2, and the second luminance value J2 may be an average value of the first luminance values B2 and D2.

The first luminance value A3 of the first color subpixel 580 may be changed into a second luminance value I3, and the first luminance value B3 of the third color subpixel 586 may be changed into a second luminance value J3. For example, the second luminance value I3 may be an average value of the first luminance values A3 and C3, and the second luminance value J3 may be an average value of the first luminance values B3 and D3.

In addition, the first color subpixels 556 and 582 arranged in the first row extending the first direction D1 may be enabled, and the first color subpixels 588 and 594 arranged in the second row extending the first direction adjacent to the first row may be disabled.

The second color subpixels 578 and 584 arranged in the first row extending the first direction D1 may be enabled, and the second color subpixels 590 and 596 arranged in the second row extending the first direction adjacent to the first row may be disabled.

The third color subpixels 580 and 586 arranged in the first row extending the first direction D1 may be enabled, and the third color subpixels 592 and 598 arranged in the second row extending the first direction adjacent to the first row may be disabled.

Referring to FIG. 22, the first luminance value B1 of the first color subpixel 576 may be changed into a second luminance value Q1, and the first luminance value D1 of the first color subpixel 594 may be changed into a second luminance value R1. For example, the second luminance value Q1 may be an average value of the first luminance values A1 and B1, and the second luminance value R1 may be an average value of the first luminance values C1 and D1.

The first luminance value B2 of the second color subpixel 578 may be changed into a second luminance value Q2, and the first luminance value D2 of the second color subpixel 596 may be changed into a second luminance value R2. For example, the second luminance value Q2 may be an average value of the first luminance values A2 and B2, and the second luminance value R2 may be an average value of the first luminance values C2 and D2.

The first luminance value B3 of the third color subpixel 580 may be changed into a second luminance value Q3, and the first luminance value D3 of the second color subpixel 598 may be changed into a second luminance value R3. For example, the second luminance value Q3 may be an average value of the first luminance values A3 and B3, and the second luminance value R3 may be an average value of the first luminance values C3 and D3.

The first color subpixels 576 and 588 arranged in the first column extending the second direction D2 may be disabled, and the first color subpixels 582 and 594 arranged in the fourth column extending the second direction D2 may be enabled.

The second color subpixels 578 and 590 arranged in the second column extending the second direction D2 may be disabled, and the second color subpixels 584 and 596 arranged in the fifth column extending the second direction D2 may be enabled.

The third color subpixels 580 and 592 arranged in the third column extending the second direction D2 may be disabled, and the third color subpixels 586 and 598 arranged in the sixth column extending the second direction D2 may be enabled. Thus, a ratio of enabled to total first color subpixels may be less than or equal to a ratio of enabled to total second color subpixels, and the ratio of enabled to total second color subpixels may be less than or equal to a ratio of enabled to total third color subpixels, for example.

According to a method of driving a display apparatus, a portion of subpixels may be disabled in a dark environment such that the display apparatus displays an image with a low luminance. In particular, on pixel ratio (OPR) may be controlled such that the display apparatus displays the image with the low luminance. Accordingly, user eye fatigue may be substantially minimized, and recognition of the display apparatus may be maintained.

Moreover, the above-described methods may be implemented on the display apparatus of FIGS. 1 and 2, or the like. One such display apparatus includes: an illuminance sensor; an image processor coupled to the illuminance sensor, the image processor including a mode decision part and an on-pixel ratio controller coupled to the mode decision part; and a display panel including a plurality of pixels coupled to the image processor, each of the plurality of pixels including a plurality of subpixels of a corresponding plurality of colors, wherein the image processor is configured to disable at least one first subpixel of at least one of the plurality of colors and adjust the luminance of remaining subpixels of the at least one of the plurality of colors based on the illuminance sensor, the mode decision part, and the on-pixel ratio controller.

In one such display apparatus, the image processor may be configured to adjust the luminance of remaining subpixels of the at least one of the plurality of colors based on an average luminance of the subpixel to be disabled and at least one closest remaining subpixel of the same color. In such a display apparatus, a ratio of disabled subpixels to total subpixels for a first of the plurality of colors may be different than a ratio of disabled subpixels to total subpixels for another of the plurality of colors.

In one such display apparatus, the plurality of colors may include a first color of red, a second color of blue, and a third color of green. In such a display apparatus, a ratio of disabled to total subpixels for a first of the plurality of colors may be greater than or equal to a ratio of disabled to total subpixels for a second of the plurality of colors, and the ratio of disabled to total subpixels for the second of the plurality of colors may be greater than or equal to a ratio of disabled to total subpixels for a third of the plurality of colors.

The above described embodiments may be used in a display apparatus and/or a system including the display apparatus, such as a mobile phone, a smart phone, a PDA, a PMP, a digital camera, a digital television, a set-top box, a music player, a portable game console, a navigation device, a personal computer (PC), a server computer, a workstation, a tablet computer, a laptop computer, a smart card, a printer, and the like.

The foregoing is illustrative of exemplary embodiments and is not to be construed as limiting thereof. Although exemplary embodiments have been described, those of ordinary skill in the pertinent art will readily appreciate that many modifications are possible in the exemplary embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other embodiments, are intended to be included within the scope of the appended claims.

What is claimed is:

1. A method of driving a display apparatus having an array of pixels, each pixel comprising one subpixel of a first color and one subpixel of another color, the method comprising:

sensing, by an illuminance sensor, an outside illuminance;

in at least an interior of the array, disabling at least one first color subpixel of a plurality of first color subpixels and enabling remaining first color subpixels of the plurality based on the sensed outside illuminance, the first color subpixels corresponding to the first color and arranged along a first direction and a second direction crossing the first direction; and displaying an image on the enabled first color subpixels, wherein a ratio of enabled first color subpixels to all first color subpixels is less than a ratio of enabled said other color subpixels to all said other color subpixels.

2. The method of claim 1, wherein disabling the at least one first color subpixel and enabling the remaining first color subpixels includes:

enabling first color subpixels arranged in a first row extending in the first direction; and disabling first color subpixels arranged in a second row adjacent to the first row.

3. The method of claim 1, wherein disabling the at least one first color subpixel and enabling the remaining first color subpixels includes:

enabling first color subpixels arranged in a first column extending in the second direction; and disabling first color subpixels arranged in a second column adjacent to the first column.

4. The method of claim 1, wherein disabling the at least one first color subpixel and enabling the remaining first color subpixels includes:

disabling first color subpixels arranged in a first row extending in the first direction; and alternately enabling and disabling first color subpixels arranged in a second row adjacent to the first row.

5. The method of claim 1, wherein disabling the at least one first color subpixel and enabling the remaining first color subpixels includes:

disabling first color subpixels arranged in a first column extending in the second direction; and alternately enabling and disabling first color subpixels arranged in a second column adjacent to the first column.

6. The method of claim 1, wherein disabling the at least one first color subpixel and enabling the remaining first color subpixels includes:

alternately enabling and disabling first color subpixels in a first region along the first and second directions such that the enabled and disabled first color subpixels in the first region are arranged in a checker board pattern.

7. The method of claim 1, wherein the display apparatus operates based on one of a column inversion driving scheme, a row inversion driving scheme, or a dot inversion driving scheme.

8. The method of claim 1, further comprising:

correcting grayscales of the first color subpixels based on the sensed outside illuminance, wherein displaying the image on the remaining enabled first color subpixels includes:

displaying the image on the remaining enabled first color subpixels based on the corrected grayscales of the first color subpixels.

9. The method of claim 1, wherein the number of the disabled first color subpixels increases as a level of the sensed outside illuminance decreases.

10. The method of claim 1, further comprising:

generating a dimming level for driving a backlight unit based on the sensed outside illuminance; and generating a light driving signal based on the dimming level and driving the backlight unit by the light driving signal, wherein a level of a luminance of a light generated by the backlight unit decreases as a level of the sensed outside illuminance decreases.

11. A method of driving a display apparatus, the method comprising:

sensing, by an illuminance sensor, an outside illuminance;

disabling at least one first color subpixel of a plurality of first color subpixels and enabling remaining first color subpixels of the plurality based on the sensed outside illuminance, the first color subpixels corresponding to a first color and arranged along a first direction and a second direction crossing the first direction;

displaying an image on the enabled first color subpixels; and correcting grayscales of the first color subpixels based on the sensed outside illuminance, wherein displaying the image on the remaining enabled first color subpixels includes displaying the image on the remaining enabled first color subpixels based on the corrected grayscales of the first color subpixels, wherein correcting the grayscales of the first color subpixels includes converting the grayscales of the first color subpixels into first luminance values of the first color subpixels, changing the first luminance values of the first color subpixels into second luminance values of the first color subpixels, and generating the corrected grayscales of the first color subpixels based on the second luminance values of the first color subpixels.

12. The method of claim 11, wherein changing the first luminance values of the first color subpixels into the second luminance values of the first color subpixels includes:

generating an average value of first luminance values of first and second subpixels of the first color subpixels, the first and second subpixels being adjacent to each other;

determining a second luminance value of the first subpixel as the average value; and determining a second luminance value of the second subpixel as a minimum value, and wherein the first subpixel is enabled, and the second subpixel is disabled.

13. The method of claim 11, wherein changing the first luminance values of the first color subpixels into the second luminance values of the first color subpixels includes:

generating an average value of first luminance values of first to fourth subpixels of the first color subpixels, the first to fourth subpixels being adjacent to one another;

determining a second luminance value of the first subpixel as the average value; and determining second luminance values of the second to fourth subpixels of the first color subpixels as a minimum value, and wherein the first subpixel is enabled, and the second to fourth subpixels are disabled.

14. The method of claim 11, wherein changing the first luminance values of the first color subpixels into the second luminance values of the first color subpixels includes:

generating a weighted average value of first luminance values of first and second subpixels of the first color subpixels, the first and second subpixels being adjacent to each other;

determining a second luminance value of the first subpixel as the weighted average value; and determining a second luminance value of the second subpixel as a minimum value, and wherein the first subpixel is enabled, and the second subpixel is disabled.

15. The method of claim 11, wherein changing the first luminance values of the first color subpixels into the second luminance values of the first color subpixels includes:

generating a weighted average value of first luminance values of first to fourth subpixels of the first color subpixels, the first to fourth subpixels being adjacent to one another;

determining a second luminance value of the first subpixel as the weighted average value; and determining second luminance values of the second to fourth subpixels of the first color subpixels as a minimum value, and wherein the first subpixel is enabled, and the second to fourth subpixels are disabled.

16. The method of claim 1, further comprising:

disabling at least one second color subpixel of a plurality of second color subpixels and enabling remaining second color subpixels of the plurality based on the sensed outside illuminance, the second color subpixels corresponding to a second color arranged along the first and second directions, each of the second color subpixels adjacent to a respective one of the first color subpixels; and displaying an image on the enabled second color subpixels.

17. The method of claim 16, wherein disabling the at least one first color subpixel and enabling the remaining first color subpixels includes:

enabling first color subpixels arranged in a first column extending in the second direction; and disabling first color subpixels arranged in a second column adjacent to the first column, wherein disabling the at least one second color subpixel and enabling the remaining second color subpixels includes:

enabling second color subpixels arranged in a third column extending in the second direction; and disabling second color subpixels arranged in a fourth column adjacent to the third column.

18. The method of claim 16, wherein disabling the at least one first color subpixel and enabling the remaining first color subpixels includes:

enabling first color subpixels arranged in a first column extending in the second direction; and disabling first color subpixels arranged in a second column adjacent to the first column, wherein disabling the at least one second color subpixel and enabling the remaining second color subpixels includes:

alternately enabling and disabling second color subpixels in a second region along the first and second directions such that the enabled and disabled second color subpixels in the second region are arranged in a checker board pattern.

19. The method of claim 16, wherein disabling the at least one first color subpixel and enabling the remaining first color subpixels includes:

alternately enabling and off first color subpixels in a third region along the first and second directions, wherein disabling the at least one second color subpixel and enabling the remaining second color subpixels includes:

alternately enabling and disabling second color subpixels in a fourth region along the first and second directions, wherein the enabled and disabled first color subpixels in the third region are arranged in a checker board pattern, and wherein the enabled and disabled second color subpixels in the fourth region are arranged in a checker board pattern.

20. The method of claim 16, wherein the first color is red or blue, and wherein the second color is green.

* * * * *